US009517570B2

(12) United States Patent
Tucker et al.

(10) Patent No.: US 9,517,570 B2
(45) Date of Patent: Dec. 13, 2016

(54) RAZOR CARTRIDGE

(71) Applicant: The Gillette Company, Boston, MA (US)

(72) Inventors: William Earle Tucker, Attleboro, MA (US); William Thomas O'Connor, Londonderry, NH (US); John Prudden, Jr., Manchester, MA (US)

(73) Assignee: The Gillette Company, Boston, MA (US)

( * ) Notice: Subject to any disclaimer, the term of this patent is extended or adjusted under 35 U.S.C. 154(b) by 366 days.

(21) Appl. No.: 13/836,455

(22) Filed: Mar. 15, 2013

(65) Prior Publication Data

US 2014/0259675 A1 Sep. 18, 2014

Related U.S. Application Data

(63) Continuation of application No. 11/788,672, filed on Apr. 20, 2007, now abandoned.

(51) Int. Cl.
*B26B 21/40* (2006.01)

(52) U.S. Cl.
CPC ..... *B26B 21/4012* (2013.01); *B26B 21/4031* (2013.01)

(58) Field of Classification Search
CPC ..... B26B 21/00–21/10; B26B 21/14; B26B 21/16; B26B 21/22–21/227; B26B 21/4012–21/4031
USPC ..... 30/47–51, 55, 74.1, 77
See application file for complete search history.

(56) References Cited

U.S. PATENT DOCUMENTS

| | | | | |
|---|---|---|---|---|
| 3,815,233 | A * | 6/1974 | Carroll | 30/47 |
| 4,083,103 | A * | 4/1978 | Estandian | 30/47 |
| 4,442,598 | A | 4/1984 | Jacobson | |
| 4,498,235 | A | 2/1985 | Jacobson | |
| 4,621,424 | A | 11/1986 | Jacobson | |
| 4,984,365 | A | 1/1991 | Leonard et al. | |
| 5,084,968 | A | 2/1992 | Trotta | |
| 5,161,307 | A | 11/1992 | Althaus | |
| 5,253,420 | A | 10/1993 | Althaus et al. | |
| 5,546,660 | A * | 8/1996 | Burout et al. | 30/50 |
| 5,661,907 | A | 9/1997 | Apprille | |
| 5,689,883 | A | 11/1997 | Ortiz et al. | |
| 5,822,869 | A | 10/1998 | Metcalf et al. | |

(Continued)

FOREIGN PATENT DOCUMENTS

| | | |
|---|---|---|
| EP | 1 226 905 B1 | 9/2003 |
| WO | WO 2005/090019 A1 | 9/2005 |

*Primary Examiner* — Jason Daniel Prone

(74) *Attorney, Agent, or Firm* — Joanne N. Pappas; Kevin C. Johnson; Steven W. Miller

(57) ABSTRACT

A razor cartridge is provided including a blade unit having a first side wall, a second side wall, and a pair of end walls interconnecting the first side wall and the second side wall and one or both of the side walls of the blade unit having at least one connection member. A plurality of blades secured to the blade unit with a clip positioned at each end of the blade unit adjacent to the end walls. A frame is provided having a first interior wall and a second interior wall spaced apart from first interior wall that define an opening extending completely through the frame. One or more of the interior walls of the frame include at least one connection member, the latter engaged with the at least one connection member of the blade unit so that the frame is secured to the blade unit.

20 Claims, 12 Drawing Sheets

(56) References Cited

U.S. PATENT DOCUMENTS 6,032,372 A * 3/2000 Dischler ..... 30/50
6,044,542 A 4/2000 Apprille et al.
6,145,201 A 11/2000 Andrews
6,161,287 A 12/2000 Swanson et al.
6,161,288 A 12/2000 Andrews
6,185,823 B1 2/2001 Brown et al.
6,216,345 B1 4/2001 Andrews
6,349,471 B1 2/2002 Gruslin et al.
6,434,828 B1 * 8/2002 Andrews ..... 30/50
6,519,856 B1 * 2/2003 Dischler ..... 30/48
6,671,961 B1 * 1/2004 Santhagens Van Eibergen et al. ..... 30/50
7,103,976 B2 * 9/2006 Pennella ..... 30/50
7,168,173 B2 1/2007 Worrick et al.
7,178,241 B1 2/2007 Cummings et al.
7,197,825 B2 4/2007 Walker et al.
D547,494 S * 7/2007 Watson et al. ..... D28/47
7,272,991 B2 9/2007 Aviza et al.
D563,043 S 2/2008 Ramm
7,540,088 B2 * 6/2009 Takeshita ..... 30/77
7,574,802 B2 * 8/2009 Pennella ..... 30/50
7,621,203 B2 * 11/2009 Aviza ..... 30/51
7,658,009 B2 * 2/2010 Bunnell et al. ..... 30/50
7,681,314 B2 * 3/2010 Follo ..... 30/50
7,703,361 B2 4/2010 Johnson et al.
7,992,304 B2 * 8/2011 Nakasuka ..... 30/50
8,037,609 B2 * 10/2011 Nicoll ..... 30/51
8,166,658 B2 5/2012 Nakasuka
8,327,546 B2 * 12/2012 Tucker ..... B26B 21/225 30/50
8,407,900 B2 * 4/2013 Johnson ..... 30/50
8,671,577 B2 * 3/2014 Brown ..... 30/50
2002/0066186 A1 * 6/2002 White et al. ..... 30/50
2004/0025350 A1 * 2/2004 Richard et al. ..... 30/50
2005/0011073 A1 * 1/2005 Sandor et al. ..... 30/50
2005/0172494 A1 * 8/2005 Aviza et al. ..... 30/50
2005/0172495 A1 8/2005 Pennella
2005/0198841 A1 9/2005 Worrick et al.
2005/0223568 A1 10/2005 Walker et al.
2006/0080837 A1 4/2006 Johnson et al.
2008/0256800 A1 10/2008 Nicoll
2008/0256801 A1 * 10/2008 O'Connor et al. ..... 30/50
2008/0256802 A1 * 10/2008 O'Connor et al. ..... 30/50
2008/0256803 A1 * 10/2008 Tucker ..... B26B 21/225 30/50
2009/0071007 A1 * 3/2009 Bruno ..... 30/77
2009/0293281 A1 12/2009 Bruno
2011/0126413 A1 * 6/2011 Szczepanowski et al. ..... 30/77
2011/0232100 A1 * 9/2011 Park et al. ..... 30/50
2011/0232101 A1 * 9/2011 Park et al. ..... 30/50
2011/0289779 A1 * 12/2011 Volodin et al. ..... 30/50
2012/0000074 A1 * 1/2012 PazosSchroeder ..... 30/34.05
2012/0151772 A1 * 6/2012 Moon et al. ..... 30/50
2012/0159787 A1 6/2012 Luxton
2013/0160296 A1 * 6/2013 Park et al. ..... 30/42
2014/0373361 A1 * 12/2014 Bozikis ..... 30/34.2
2014/0373362 A1 * 12/2014 Bozikis ..... 30/50
2015/0090085 A1 * 4/2015 Griffin et al. ..... 30/50
2016/0121499 A1 * 5/2016 Yoo ..... B26B 21/56 30/50
2016/0129603 A1 * 5/2016 Antoniou ..... B26B 21/44 30/50

* cited by examiner

RAZOR CARTRIDGE

CROSS REFERENCE TO RELATED APPLICATION

This application is a Continuation of U.S. application Ser. No. 11/788,672, filed on Apr. 20, 2007.

FIELD OF THE INVENTION

The present invention is directed to a razor cartridge and more particularly to a razor cartridge constructed of a blade unit and a frame secured to the blade unit.

BACKGROUND OF THE INVENTION

Razor cartridges are designed to cut or shave a user's hair. The cartridges include one or more blades having at least one sharpened edge. The blades are held in place by what is commonly referred to as a housing. The housing typically includes one or more features to improve the overall shaving experience. Such common features include a guard which is located on the housing in front of the blades and a cap which is located behind the blades. The guard often includes an elastomeric member and the cap often includes a lubricating strip of some kind.

On the market today are a vast number of razor cartridge configurations. Some have big guards, some have smaller guards, some guards have elastomeric members with fins while others have elastomeric members with depressions and some guards have lubricating strips. Similarly some razor cartridges have big caps, some have smaller caps, and some caps have a lubricating strip.

In order to meet the demands of consumers, numerous designs have been configured. The numerous designs come at a cost however as much effort is spent on each design. That is, each cartridge is designed from scratch such that none of the molds and production equipment used to make one cartridge can be utilized to make a cartridge of a different design. For example, the molds and production equipment used to make the Gillette™ Mach3™ razor cartridge could not be used to make the Gillette™ Fusion™ razor cartridge. This results in higher cost as product design, molding and production equipment has to be executed separately for each product. Thus, there is a need for an alternative design to reduce cost and effort to produce different razor cartridges to meet the demands of consumers.

Ideally, one would like to start with a standard blade unit that houses the blades. One could then have the flexibility to add frames of various configurations to the standard blade unit. To keep the blade unit in its simplest form the pivot portion of the cartridge should be part of the frame and not part of the blade unit.

SUMMARY OF THE INVENTION

In accordance with the present invention a razor cartridge for connecting to a handle is provided. The razor cartridge comprises a blade unit comprising a plurality of shaving blades. The shaving blades extend along respective parallel blade axes. The shaving blades comprise sharpened edges. The sharpened edges define a blade plane. A frame is secured to the blade unit. The frame has a frame perimeter, an upper surface and a pivoting structure. The frame perimeter defines a razor cartridge perimeter for the razor cartridge. The pivoting structure defines a pivot axis for pivoting the razor cartridge with respect to the handle. The pivot axis is positioned within the frame such that a line drawn through the pivot axis perpendicular to the blade plane intersects the upper surface of the frame at a pivot frame intersection location where a tangent line drawn along the upper surface at the pivot frame intersection location is parallel to the blade plane. A first planar surface on the upper surface is located in front of the pivot frame intersection location and a second planar surface on the upper surface is located behind the pivot frame intersection location. The first planar surface is coplanar with the second planar surface.

In accordance with another aspect of the present invention a razor cartridge for connecting to a handle is provided. The razor cartridge comprises a blade unit comprising a plurality of shaving blades. The shaving blades extend along respective parallel blade axes. The shaving blades comprise sharpened edges. The sharpened edges define a blade plane. A frame is secured to the blade unit. The frame has a frame perimeter, an upper surface and a pivoting structure. The frame perimeter defines a razor cartridge perimeter for the razor cartridge. The pivoting structure defines a pivot axis for pivoting the razor cartridge with respect to the handle. The pivot axis is positioned within the frame between the upper surface and the lower surface such that a line drawn through the pivot axis perpendicular to the blade plane intersects the upper surface of the frame at a pivot frame intersection location where a tangent line drawn along the upper surface at the pivot frame intersection location is parallel to the blade plane. A first planar surface on the upper surface is located in front of the pivot frame intersection location and a second planar surface on the upper surface is located behind the pivot frame intersection location. The first planar surface is coplanar with the second planar surface.

In accordance with another aspect of the present invention a razor cartridge for connecting to a handle is provided. The razor cartridge comprises a blade unit comprising a plurality of shaving blades secured to the blade unit. The shaving blades extend along respective parallel blade axes. The shaving blades comprise sharpened edges. The sharpened edges define a blade plane. A frame is secured to the blade unit. The frame has a frame perimeter, an upper surface and a pivoting structure. The frame perimeter defines a razor cartridge perimeter for the razor cartridge. The pivoting structure defines a pivot axis for pivoting the razor cartridge with respect to the handle. The pivot axis is positioned within the frame between the upper surface and the lower surface such that a line drawn through the pivot axis perpendicular to the blade plane intersects the upper surface of the frame at a pivot frame intersection location where a tangent line drawn along the upper surface at the pivot frame intersection location is parallel to the blade plane. A first planar surface on the upper surface is located in front of the pivot frame intersection location and a second planar surface on the upper surface is located behind the pivot frame intersection location. The first planar surface is coplanar with the second planar surface.

In accordance with the present invention the pivot axis may be located in front of the blade axes or in back of the blade axes.

In accordance with the present invention the blade unit comprises a first shaving blade and a last shaving blade, said first shaving blade extends along a first blade axis and the last shaving blade extends along a last blade axis. The pivot axis may be located in between the first blade axis and the last blade axis, at the first blade axis or at the last blade axis.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
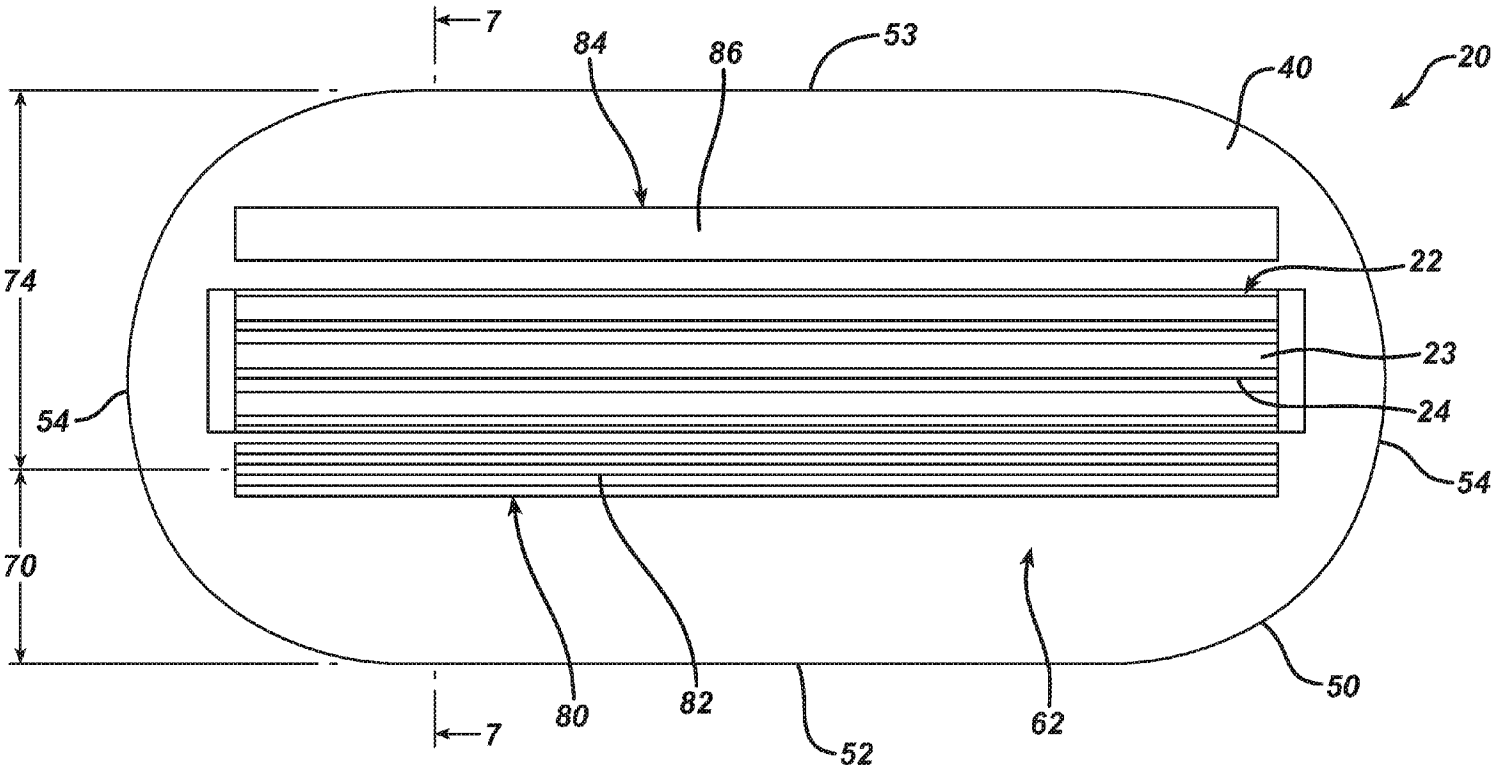
FIG. 1 is a top plan view of a razor cartridge of the present invention.
Figure 2:
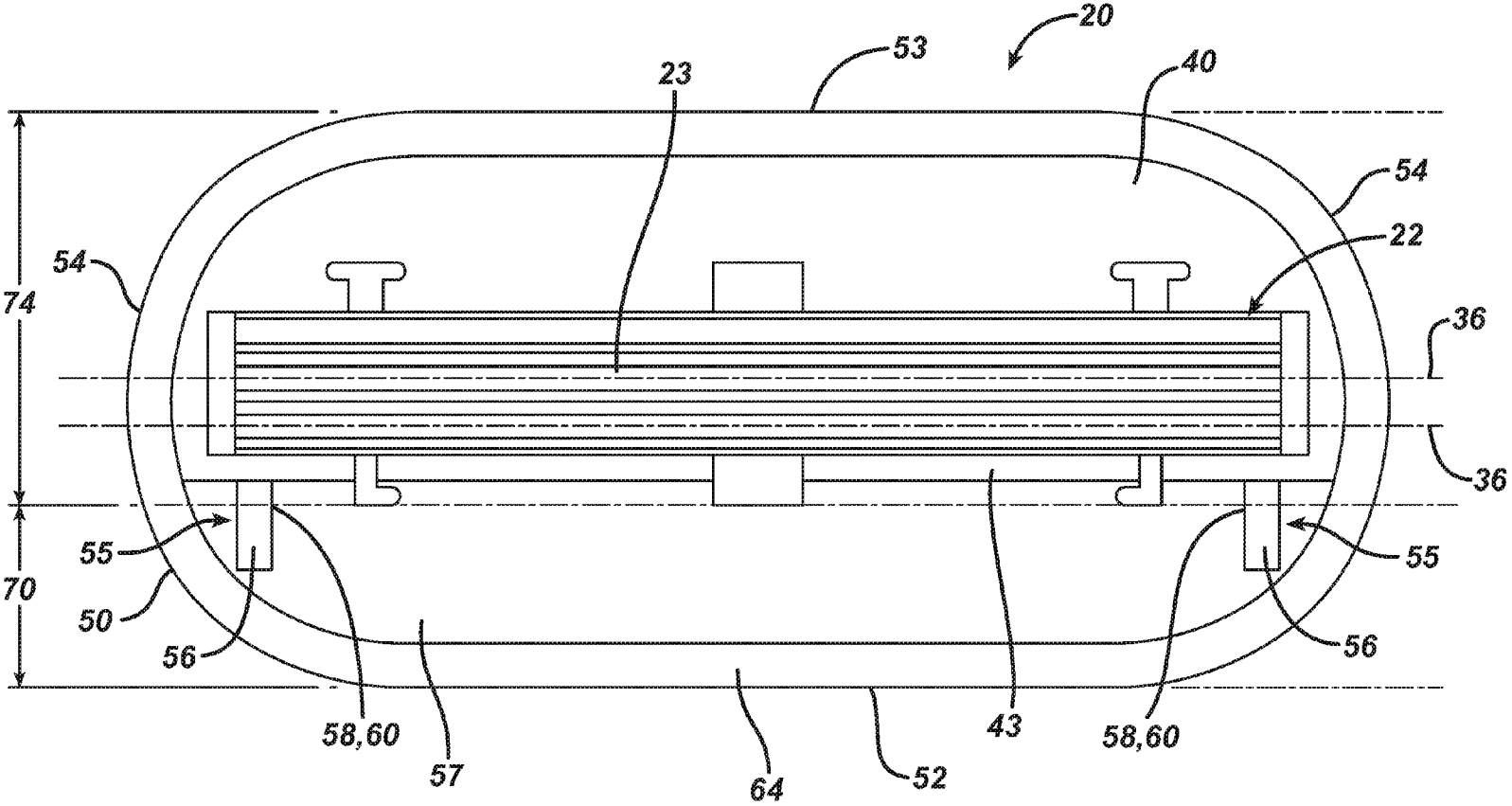
FIG. 2 is a bottom plan view of the razor cartridge of FIG. 1.

Referring now to FIGS. 1-2, there is shown a razor cartridge 20. The razor cartridge 20 comprises a blade unit 22 and a frame 40 secured to and surrounding the blade unit 22. The blade unit 22 comprises a plurality of blades 23 each comprising a blade edge 24.

Figure 3:
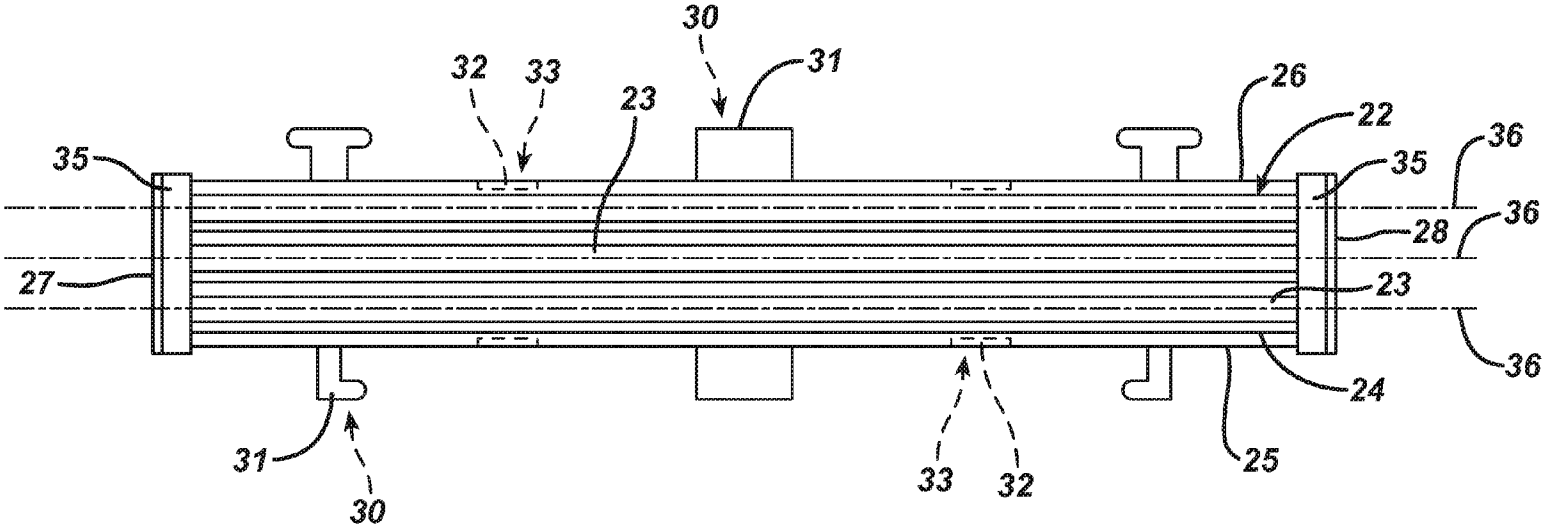
FIG. 3 is a top plan view of the blade unit of FIG. 1 shown without the frame.
Figure 4:
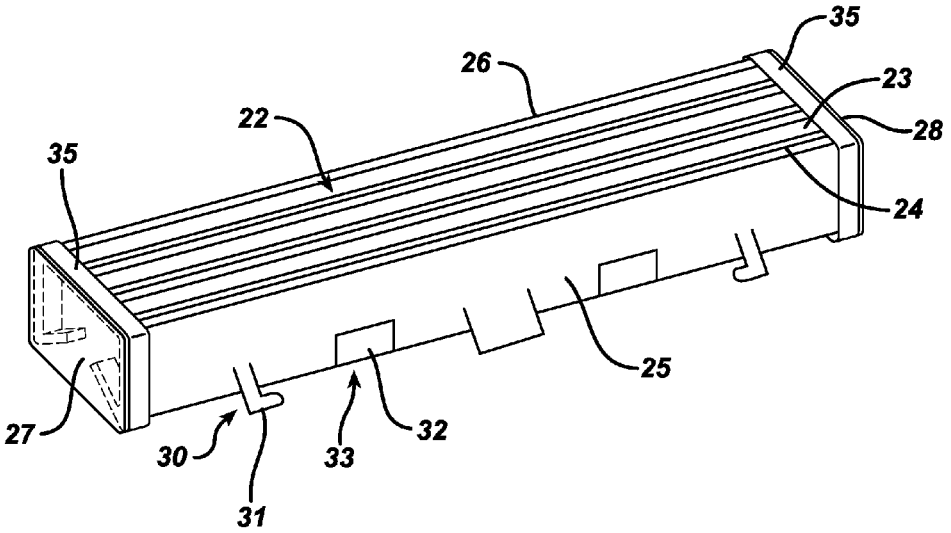
FIG. 4 is a perspective view of the blade unit of FIG. 3.

Referring now to FIGS. 3-4, the blade unit 22 is provided with first side wall 25, second side wall 26, and end walls 27 and 28 interconnecting the first side wall 25 and the second side wall 26. The first side wall 25 and the second side wall 26 are provided with first connection members 30 and second connection members 32. Preferably, first connection members 30 comprise projections 31 extending outwardly from each of first and second side walls 25 and 26. Preferably, second connections members 32 comprise recesses 33 in each of the first and second side walls 25 and 26.

Blades 23 are secured within blade unit 22 by a pair of clips 35. Each clip 35 is positioned at an end of blade unit 22 adjacent to end walls 27 and 28. Blades 23 are secured within blade unit 22 by clips 35 such that blade edges 24 contact the bottom surface of clips 35. Blades 23 extend along respective parallel blade axes 36.

Figure 5:
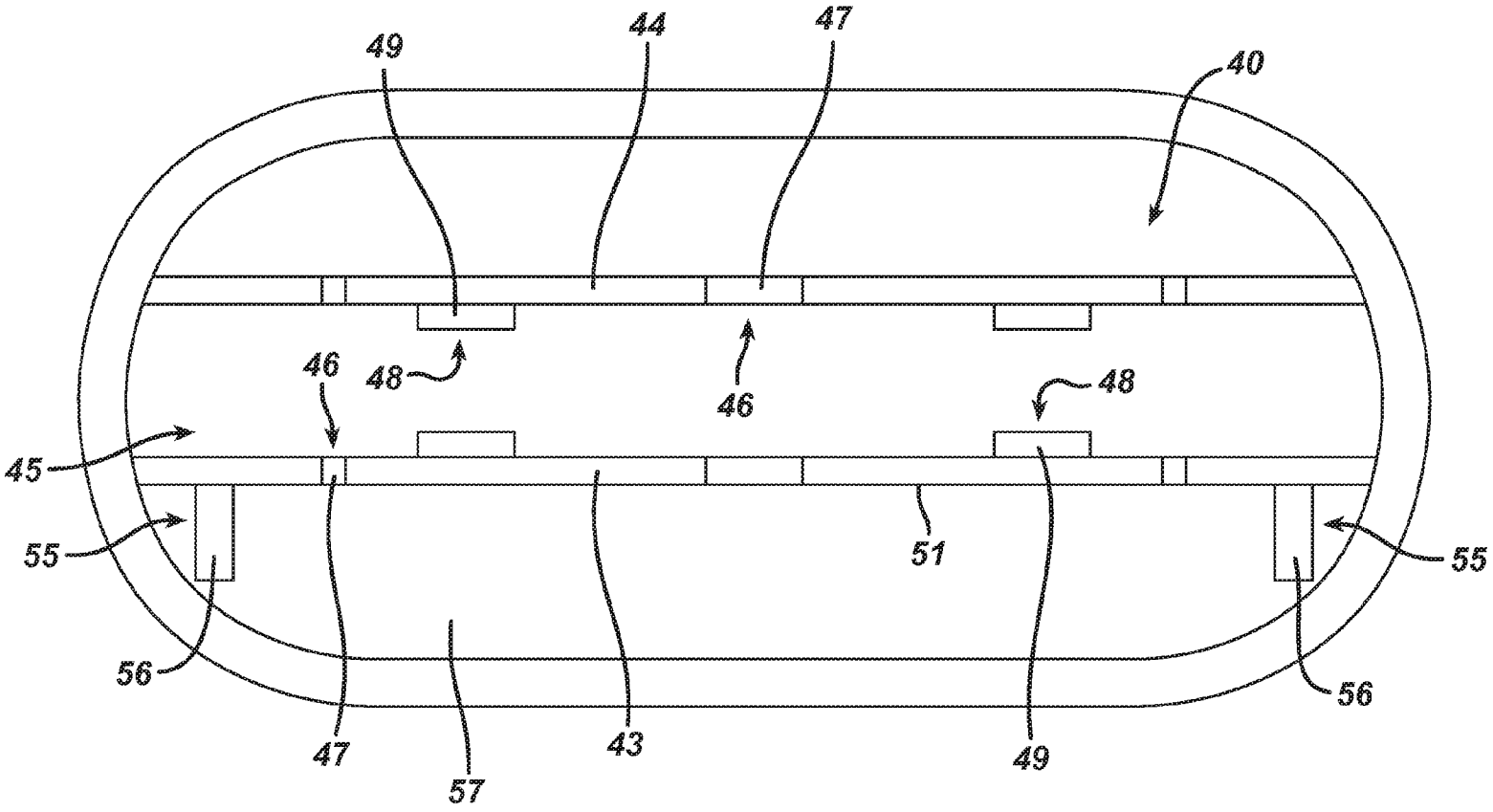
FIG. 5 is a bottom plan view of the frame of FIG. 1 shown without the blade unit.
Figure 6:
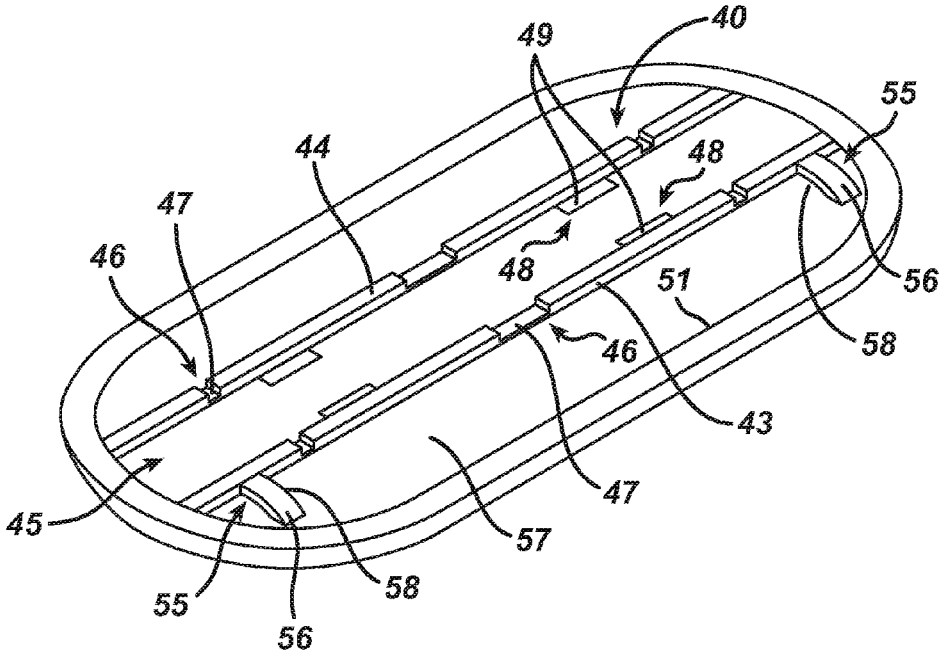
FIG. 6 is a perspective view of the frame of FIG. 5.

Referring now to FIGS. 5-6, frame 40 is provided with a first interior wall 43 and a second interior wall 44 spaced apart from first interior wall 43 to define an opening 45. Opening 45 is sized and shaped to receive blade unit 22. The first interior wall 43 and the second interior wall 44 are provided with first connection members 46 and second connection members 48. Preferably, first connection members 46 comprise notches 47 in each of the first and second interior walls 43 and 44. Preferably, the second connection members 48 comprise projections 49 extending outwardly from each of the first and second interior walls into opening 45.

First connection members 46 on interior walls 43 and 44 are adapted to receive first connection members 30 on side walls 25 and 26. Second connection members 48 on interior walls 43 and 44 are adapted to receive second connection members 32 on side walls 25 and 26. In securing the frame 40 to the blade unit 20 the projections 31 slide into notches 47 and projections 49 snap into recesses 33.

Referring now to FIGS. 1 and 2 frame 40 has a perimeter 50. Perimeter 50 of frame 40 defines a razor cartridge perimeter 51 for razor cartridge 20. Perimeter 50 comprises a front surface 52, a rear surface 53 and a pair of side surfaces 54 extending from front surface 52 to rear surface 53. Frame 40 also has an upper surface 62 and an opposing lower surface 64.

Referring now to FIGS. 2, 5 and 6, at each end of frame 40 there is a pivoting structure 55. Pivoting structure 55 includes an arm 56 extending from interior surface 57 of frame 40 to first interior wall 43 to define a recess 58. Recess 58 of pivoting structure 55 defines the pivot axis 60 for the razor cartridge 20 and while the pivot axis 60 is within the recess 58 it is not the same as recess 58.

Pivot axis 60 is located within frame 40, below upper surface 62, above lower surface 64, and in front of the blade axes 36. The pivot axis 60 divides the razor cartridge 20 into a front portion 70 and a rear portion 74. Front portion 70 extends from pivot axis 60 to front surface 52. Rear portion 74 extends from pivot axis 60 to rear surface 53. Preferably, the front portion is less than the rear portion. Preferably, the front portion 70 extends from the pivot axis 60 to the front surface 52 by a distance from about 6 mm to about 12 mm. Preferably, the rear portion 74 extends from the pivot axis 60 to the rear surface 53 by a distance from about 15 mm to about 20 mm.

Referring now to FIG. 1, the front portion 70 of upper surface 62 includes guard 80. Guard 80 is that portion of upper surface 62 of frame 40 that contacts the skin prior to or before blade edges 23. Guard 80 preferably comprises an elastomeric member 82.

The rear portion 74 of upper surface 62 includes a cap 84. Cap 84 is that portion of upper surface 62 of frame 40 that contacts the skin after blade edges 23. Cap 84 preferably comprises a lubrication member 86.

Figure 7:
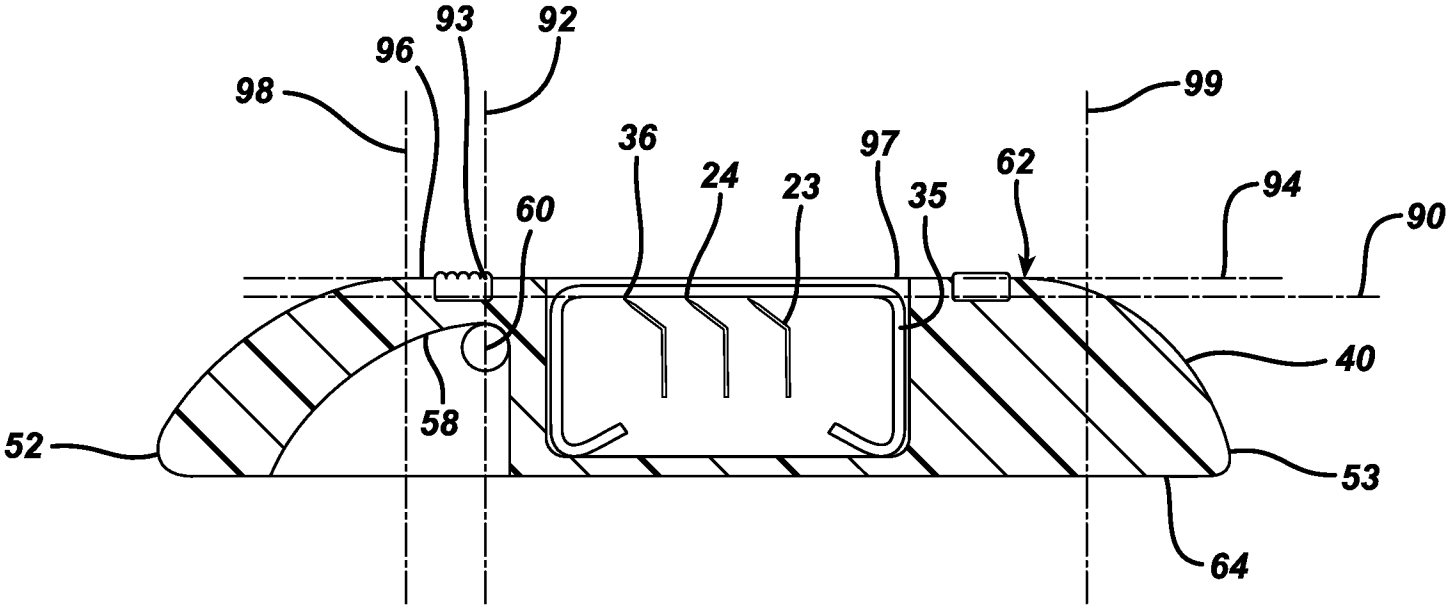
FIG. 7 is a cross-sectional view of the razor cartridge of FIG. 1 taken along section line 7-7.

Referring now to FIG. 7, blade edges 24 of blades 23 define a blade plane 90. In this embodiment pivot axis 60 is located in front of blade axes 36 and thus closer to front surface 52 than rear surface 53. Pivot axis 60 is positioned within frame 40, below upper surface 62 and above lower surface 64 such that a line 92 drawn through pivot axis 60 perpendicular to blade plane 90, intersects upper surface 62 at a pivot frame intersection location 93. A tangent line, such as tangent line 94, drawn along upper surface 62 at pivot frame intersection location 93 will always be parallel to blade plane 90. This is one requirement for properly positioning of the pivot axis 60 within frame 40.

The second requirement for proper positioning of pivot axis 60 within frame 40 is that the frame 40 must have a first planar surface on the upper surface 62 in front of pivot frame intersection location 93 and a second planar surface on the upper surface located behind the pivot frame intersection location 93 and that these two surfaces be coplanar with one another. As seen in FIG. 7, first planar surface 96 on upper surface 62 is in front of pivot frame intersection location 93 and second planar surface 97 on upper surface 62 is located behind the pivot frame intersection location 93. The first planar surface 96 is coplanar with the second planar surface 97. The first planar surface 96 extends along upper surface 62 from line 92 to line 98 and second planar surface 97 extends along upper surface 62 from line 92 to line 99.

Figure 8:
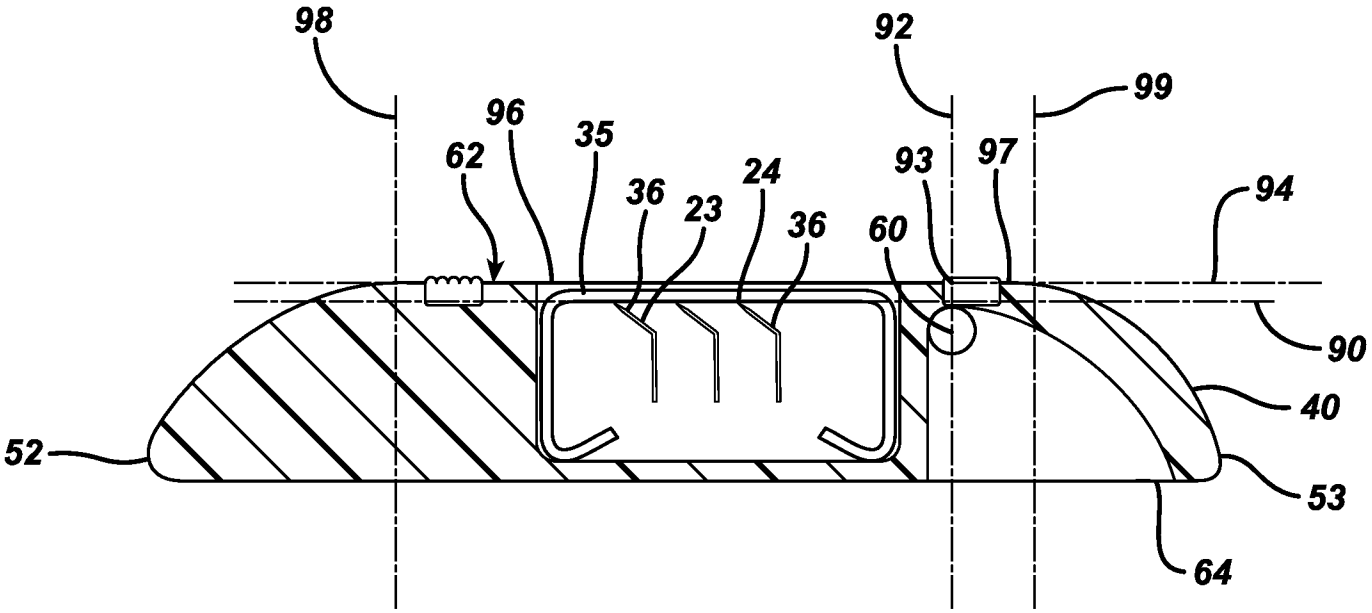
FIG. 8 is a cross-sectional view of another razor cartridge of the present invention.

Referring now to FIG. 8, blade edges 24 of blades 23 define a blade plane 90. In this embodiment pivot axis 60 is located in behind blade axes 36 and thus closer to rear surface 53 than front surface 52. Pivot axis 60 is positioned within frame 40, below upper surface 62 and above lower surface 64 such that a line 92 drawn through pivot axis 60 perpendicular to blade plane 90, intersects upper surface 62 at a pivot frame intersection location 93. A tangent line, such as tangent line 94, drawn along upper surface 62 at pivot frame intersection location 93 will always be parallel to blade plane 90. This is one requirement for properly positioning of the pivot axis 60 within frame 40.

The second requirement for proper positioning of pivot axis 60 within frame 40 is that the frame 40 must have a first planar surface on the upper surface 62 in front of pivot frame intersection location 93 and a second planar surface on the upper surface located behind the pivot frame intersection location 93 and that these two surfaces be coplanar with one another. As seen in FIG. 8, first planar surface 96 on upper surface 62 is in front of pivot frame intersection location 93 and second planar surface 97 on upper surface 62 is located behind the pivot frame intersection location 93. The first planar surface 96 is coplanar with the second planar surface 97. The first planar surface 96 extends along upper surface 62 from line 92 to line 98 and second planar surface 97 extends along upper surface 62 from line 92 to line 99.

Figure 9:
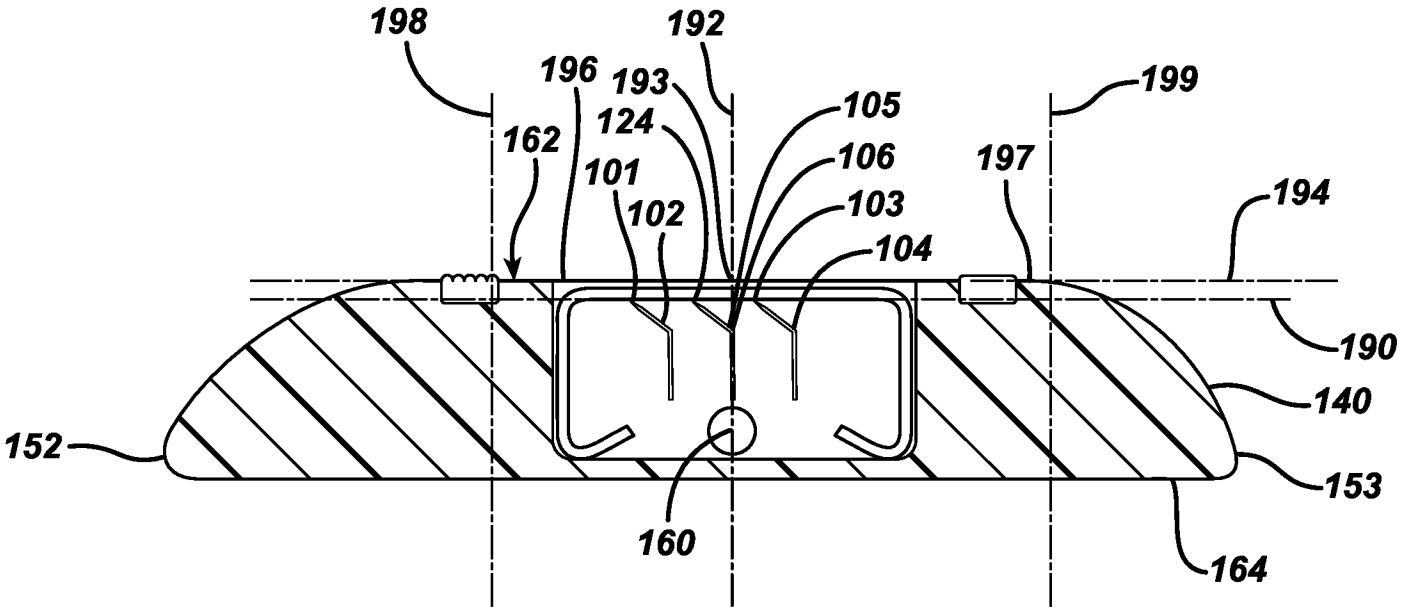
FIG. 9 is a cross-sectional view of another razor cartridge of the present invention.

Referring now to FIG. 9, a first shaving blade 101 extends along a first blade axis 102 and a last shaving blade 103 extends along a last blade axis 104. A second shaving blade 105 positioned between first shaving blade 101 and last shaving blade 103 extends along a second blade axis 106. Blade edges 124 of blades 101, 103 and 105 define a blade plane 190. In this embodiment pivot axis 160 is located in between first blade axis 102 and last blade axis 104. The pivot axis 160 is spaced equidistant from front surface 152 and rear surface 153. Pivot axis 160 is positioned within frame 140 below upper surface 162 and above lower surface 164 such that a line 192 drawn through pivot axis 160 perpendicular to blade plane 190, intersects upper surface 162 at a pivot frame intersection location 193. A tangent line, such as tangent line 194, drawn along upper surface 162 at pivot frame intersection location 193 will always be parallel to blade plane 190. This is one requirement for properly positioning of the pivot axis 160 within frame 140.

The second requirement for proper positioning of pivot axis 160 within frame 140 is that the frame 140 must have a first planar surface on the upper surface 162 in front of pivot frame intersection location 193 and a second planar surface on the upper surface located behind the pivot frame intersection location 193 and that these two surfaces be coplanar with one another. As seen in FIG. 9, first planar surface 196 on upper surface 162 is in front of pivot frame intersection location 193 and second planar surface 197 on upper surface 162 is located behind the pivot frame intersection location 193. The first planar surface 196 is coplanar with the second planar surface 197. The first planar surface 196 extends along upper surface 162 from line 192 to line 198 and second planar surface 197 extends along upper surface 162 from line 192 to line 199.

Figure 10:
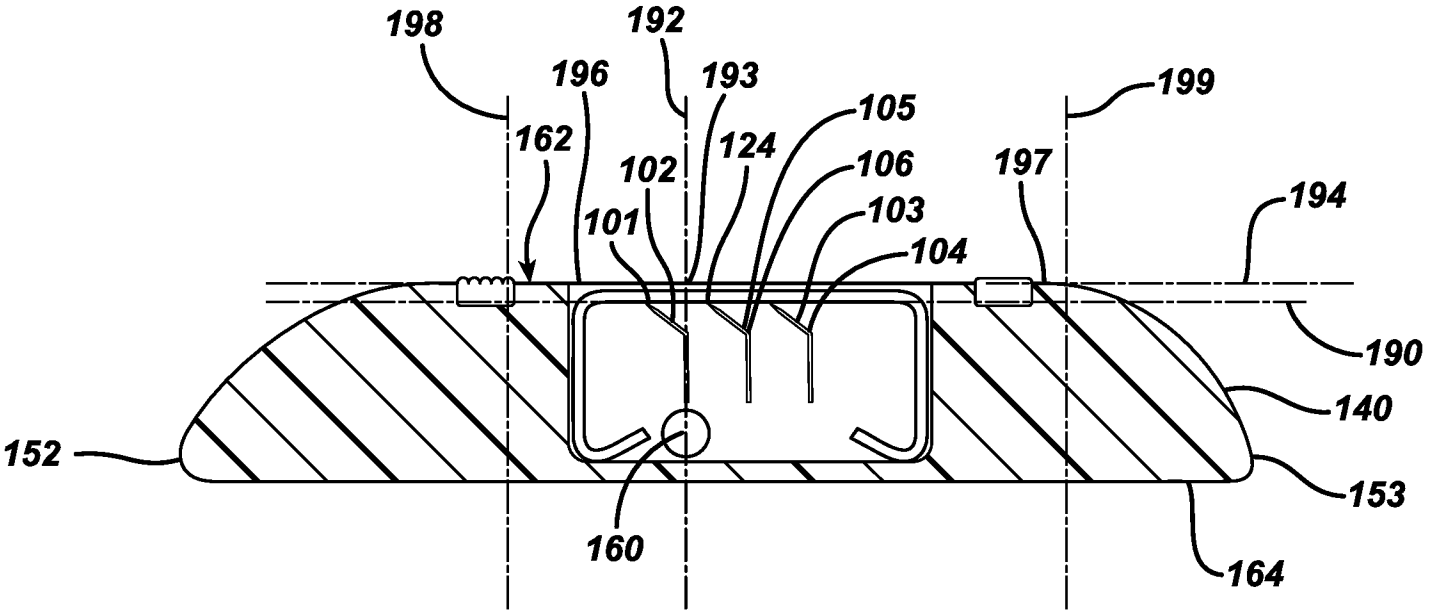
FIG. 10 is a cross-sectional view of another razor cartridge of the present invention.

Referring now to FIG. 10, a first shaving blade 101 extends along a first blade axis 102 and a last shaving blade 103 extends along a last blade axis 104. A second shaving blade 105 positioned between first shaving blade 101 and last shaving blade 103 extends along a second blade axis 106. Blade edges 124 of blades 101, 103 and 105 define a blade plane 190. In this embodiment pivot axis 160 is located at the first blade axis 102. The pivot axis 160 is spaced closer to front surface 152 than rear surface 153. Pivot axis 160 is positioned within frame 140 below upper surface 162 and above lower surface 164 such that a line 192 drawn through pivot axis 160 perpendicular to blade plane 190, intersects upper surface 162 at a pivot frame intersection location 193. A tangent line, such as tangent line 194, drawn along upper surface 162 at pivot frame intersection location 193 will always be parallel to blade plane 190. This is one requirement for properly positioning of the pivot axis 160 within frame 140.

The second requirement for proper positioning of pivot axis 160 within frame 140 is that the frame 140 must have a first planar surface on the upper surface 162 in front of pivot frame intersection location 193 and a second planar surface on the upper surface located behind the pivot frame intersection location 193 and that these two surfaces be coplanar with one another. As seen in FIG. 10, first planar surface 196 on upper surface 162 is in front of pivot frame intersection location 193 and second planar surface 197 on upper surface 162 is located behind the pivot frame intersection location 193. The first planar surface 196 is coplanar with the second planar surface 197. The first planar surface 196 extends along upper surface 162 from line 192 to line 198 and second planar surface 197 extends along upper surface 162 from line 192 to line 199.

Figure 11:
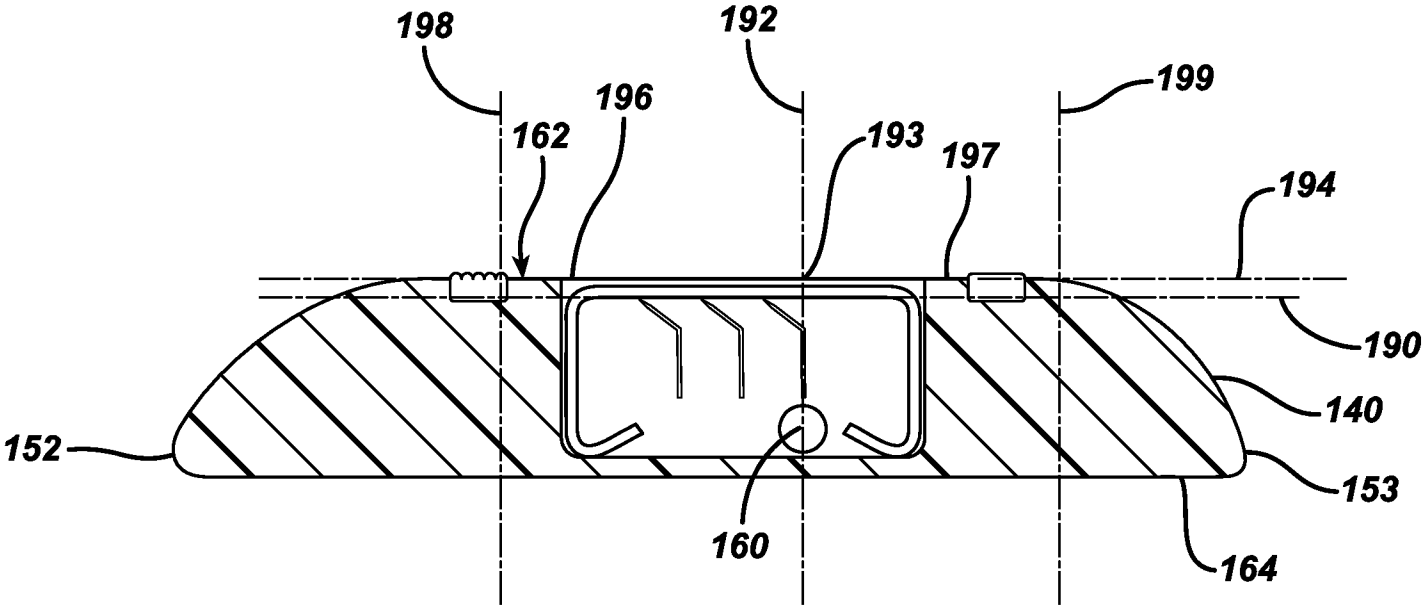
FIG. 11 is a cross-sectional view of another razor cartridge of the present invention.

Referring now to FIG. 11, a first shaving blade 101 extends along a first blade axis 102 and a last shaving blade 103 extends along a last blade axis 104. A second shaving blade 105 positioned between first shaving blade 101 and last shaving blade 103 extends along a second blade axis 106. Blade edges 124 of blades 101, 103 and 105 define a blade plane 190. In this embodiment pivot axis 160 is located at the second blade axis 104. The pivot axis 160 is spaced closer to rear surface 153 than front surface 152. Pivot axis 160 is positioned within frame 140 below upper surface 162 and above lower surface 164 such that a line 192 drawn through pivot axis 160 perpendicular to blade plane 190, intersects upper surface 162 at a pivot frame intersection location 193. A tangent line, such as tangent line 194, drawn along upper surface 162 at pivot frame intersection location 193 will always be parallel to blade plane 190. This is one requirement for properly positioning of the pivot axis 160 within frame 140.

The second requirement for proper positioning of pivot axis 160 within frame 140 is that the frame 140 must have a first planar surface on the upper surface 162 in front of pivot frame intersection location 193 and a second planar surface on the upper surface located behind the pivot frame intersection location 193 and that these two surfaces be coplanar with one another. As seen in FIG. 11, first planar surface 196 on upper surface 162 is in front of pivot frame intersection location 193 and second planar surface 197 on upper surface 162 is located behind the pivot frame intersection location 193. The first planar surface 196 is coplanar with the second planar surface 197. The first planar surface 196 extends along upper surface 162 from line 192 to line 198 and second planar surface 197 extends along upper surface 162 from line 192 to line 199.

Figure 12:
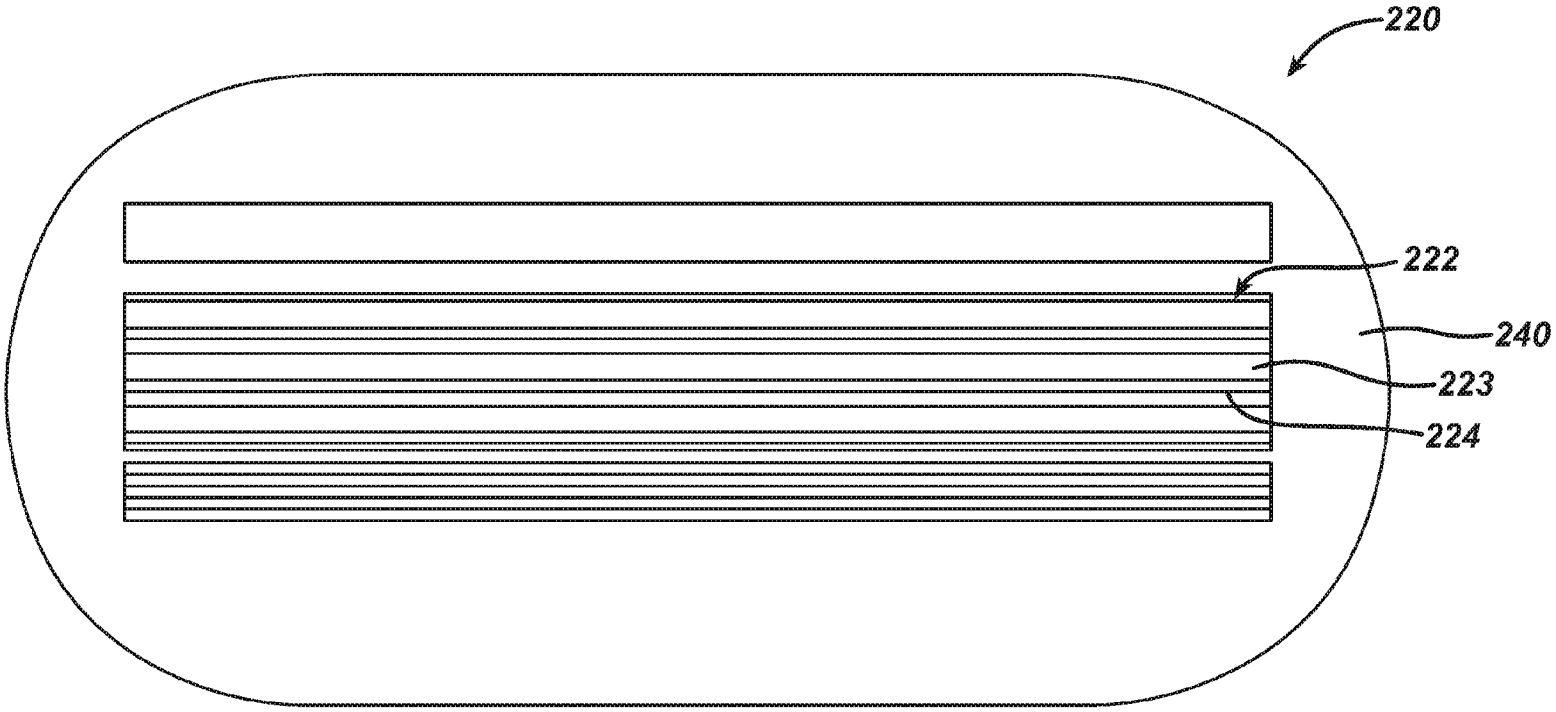
FIG. 12 is a top plan view of another razor cartridge of the present invention.

Referring now to FIG. 12, there is shown a razor cartridge 220. The razor cartridge 220 comprises a blade unit 222 and a frame 240 secured to and surrounding the blade unit 222. The blade unit 222 comprises a plurality of blades 223 each comprising a blade edge 224. Razor cartridge 220 is identical to razor cartridge 20 of FIG. 1 except that no clips are used to secure blades 223 within blade unit 222. Instead, a portion of frame 240 extends over each end of blade unit 222 to maintain blades 223 within blade unit 222. A partial cut-away of one end of frame 240 in FIG. 12 reveals the underlying blades 223 within blade unit 222.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising:

a blade unit having a first side wall, a second side wall, and a pair of end walls interconnecting the first side wall and the second side wall, wherein said first side wall and said second side wall of the blade unit each further comprise at least one connection member;

a plurality of blades secured within the blade unit by a pair of clips, each clip positioned at an end of the blade unit adjacent to the end walls, each blade comprising a blade edge;

a plastic frame having a first interior wall and a second interior wall spaced apart from first interior wall to define an opening, the opening sized and shaped to receive the blade unit and extending completely through the frame, wherein said first interior wall and said second interior wall of the frame each further comprise at least one connection member, one of the at least one connection member of the first interior wall of the frame engaged with one of the at least one connection member of the first side wall of the blade unit or one of the at least one connection member of the second interior wall of the frame engaged with one of the at least one connection member of the second side wall of the blade unit to secure the frame to the blade unit.

2. The razor cartridge of claim 1 further comprising a lubrication member at a rear portion of the frame.

3. The razor cartridge of claim 1 further comprising a guard in front of the blades, the guard comprising an elastomeric member.

4. The razor cartridge of claim 3 wherein the guard is positioned on the frame.

5. The razor cartridge of claim 1 wherein the blade edges contact a bottom surface of the clips.

6. The razor cartridge of claim 1 wherein the engagement between the connection members is a snap fit engagement.

7. The razor cartridge of claim 1 wherein the at least one connection member of the blade unit comprise one or more projections extending outwardly from said first side wall and/or said second side wall, one or more recesses in said first side wall and/or said second side wall, or any combination thereof.

8. The razor cartridge of claim 1 wherein the at least one connection member of the frame comprise one or more projections extending outwardly into the opening from the first and/or second interior walls of the frame, one or more notches in the first and/or second interior walls of the frame, or any combination thereof.

9. The razor cartridge of claim 1 wherein the at least one connection member of the frame comprise one or more projections extending outwardly into the opening from the first and/or second interior walls of the frame and the at least one connection member of the blade unit comprises one or more recesses in said first side wall and/or said second side wall.

10. The razor cartridge of claim 9 wherein the engagement between the connection members is a snap fit engagement of the one or more projections of the frame into the one or more recesses of the blade unit.

11. The razor cartridge of claim 1 wherein the at least one connection member of the blade unit comprises one or more projections extending outwardly from said first side wall and/or said second side wall and wherein at least one connection member of the frame comprises one or more notches in the first and/or second interior walls of the frame.

12. The razor cartridge of claim 11 wherein the engagement between the connection members is a slide engagement of the one or more projections of the blade unit into the one or more notches of the frame.

13. The razor cartridge of claim 1 wherein the first and second side walls of the blade unit and the first and second interior walls of the frame extend parallel to the blade edges.

14. A razor cartridge comprising:

a plurality of blades secured within a blade unit by a pair of clips, each blade comprising a blade edge, the blade unit having a first side wall and a second side wall, said side walls extending parallel to the blade edges, and a pair of end walls interconnecting the first side wall and the second side wall, each clip positioned at an end of the blade unit adjacent to the end walls, and wherein said first side wall and said second side wall of the blade unit each further comprise at least one connection member; and a plastic frame having a first interior wall and a second interior wall spaced apart from first interior wall to define an opening, the opening extending completely through the frame, the interior walls extending parallel to the blade edges, wherein said first interior wall and said second interior wall of the frame each further comprise at least one connection member, the at least one connection members of the first interior wall of the frame engaged with the at least one connection members of the first side wall of the blade unit or the at least one connection members of the second interior wall of the frame engaged with the at least one connection members of the second side wall of the blade unit securing the frame to the blade unit.

15. The razor cartridge of claim 14 wherein the at least one connection member of the blade unit comprise one or more projections extending outwardly from said first side wall and/or said second side wall, one or more recesses in said first side wall and/or said second side wall, or any combination thereof and wherein the at least one connection member of the frame comprise one or more projections extending outwardly into the opening from the first and/or second interior walls of the frame, one or more notches in the first and/or second interior walls of the frame, or any combination thereof.

16. The razor cartridge of claim 15 wherein the one or more notches of the frame are adapted to receive the one or more projections of the blade unit.

17. The razor cartridge of claim 15 wherein the one or more recesses of the blade unit are adapted to receive the one or more projections of the frame.

18. The razor cartridge of claim 14 wherein the engagement between connection members is a snap fit engagement.

19. A razor cartridge comprising:

a blade unit having a first side wall, a second side wall, and a pair of end walls interconnecting the first side wall and the second side wall, wherein said first side wall and said second side wall of the blade unit further comprise at least one connection member;

a plurality of blades secured within the blade unit by a pair of clips, each clip positioned at an end of blade unit adjacent to the end walls, each blade comprising a blade edge;

a guard in front of the blades, the guard comprising an elastomeric member;

a plastic frame having a first interior wall and a second interior wall spaced apart from first interior wall to define an opening, the opening sized and shaped to receive the blade unit and extending completely through the frame, wherein said first interior wall and/or said second interior wall of the frame further comprise at least one connection member, and wherein the at least one connection member of the first side wall of the blade unit is engaged with the at least one connection member of the first interior wall of the frame and/or the at least one connection member of the second side wall of the blade unit is engaged with the at least one connection member of the second interior wall of the frame, the frame and the blade unit secured to each other; and a lubrication member at a rear portion of the frame.

20. The razor cartridge of claim 19 wherein the engagement between connection members is a snap fit engagement frame.

* * * * *